US005950404A

United States Patent [19]

Meyer et al.

[11] Patent Number: 5,950,404

[45] **Date of Patent: *Sep. 14, 1999**

[54] APPARATUS FOR PACKING ARTICLES

[75] Inventors: Erich Meyer; Andreas Rothbauer, both of Schwaebisch Hall; Dietmar Schmetzer, Gschlachtenbretzingen, all of Germany

[73] Assignee: OPTIMA-Maschinenfabrik Dr. Buhler GmbH & Co., Schwaebisch Hall, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/885,272

[22] Filed: Jun. 30, 1997

[30] Foreign Application Priority Data

Jul. 3, 1996 [DE] Germany ..... 196 26 665

[51] Int. Cl.[6] ..... B65B 1/24

[52] U.S. Cl. ..... 53/529; 53/381.1; 53/384.1; 53/530; 53/570

[58] Field of Search ..... 53/436, 529, 530, 53/381.1, 570, 469, 384.1, 386.1, 477, 373.7, 284.7

[56] References Cited

U.S. PATENT DOCUMENTS

| | | | |
|---|---|---|---|
| 3,968,619 | 7/1976 | Fishburne | 53/469 |
| 4,047,362 | 9/1977 | Lister et al. | 53/189 |
| 4,183,194 | 1/1980 | Lucke | 53/571 |
| 4,248,032 | 2/1981 | Woods et al. | 53/570 |
| 4,385,478 | 5/1983 | Veerkamp | 53/570 |
| 4,590,748 | 5/1986 | Harrison et al. | 53/570 |
| 4,914,895 | 4/1990 | Kuckhermann et al. | 53/386.1 |
| 5,170,609 | 12/1992 | Bullock et al. | 53/512 |
| 5,682,734 | 11/1997 | Laster | 53/284.7 |
| 5,685,129 | 11/1997 | Baker | 53/469 |
| 5,687,544 | 11/1997 | Watabe et al. | 53/570 |

FOREIGN PATENT DOCUMENTS

| | | |
|---|---|---|
| 19 20 959 | 6/1965 | Germany . |
| 19 76 534 | 1/1968 | Germany . |
| 19 94 977 | 10/1968 | Germany . |
| 68 00 717 | 4/1969 | Germany . |
| 31 29 205 C2 | 11/1984 | Germany . |
| 39 35 457 A1 | 2/1991 | Germany . |

*Primary Examiner*—James F. Coan
*Assistant Examiner*—Gene L. Kim
*Attorney, Agent, or Firm*—Quarles & Brady LLP

[57] ABSTRACT

An apparatus for packing articles contains successively in a conveying direction a feed station, where the articles to be packed are fed into the installation, a station for opening the pack and a station for sealing the filled pack. The two stations, optionally also a compressing station, are successively located on rails, to which they can be fixed in random positions. Consequently it is possible to modify the mutual spacings of the stations and the absolute positions of the stations. This makes it possible to adapt the apparatus to different pack sizes, different articles to be packed and further differing circumstances, whilst still allowing short conveying paths.

14 Claims, 4 Drawing Sheets

APPARATUS FOR PACKING ARTICLES

TECHNICAL FIELD

The invention relates to an apparatus for packing articles.

DESCRIPTION OF THE BACKGROUND ART

These apparatuses conventionally have a feed location at which the articles to be packed are introduced individually or in stack form into the apparatus. From there they are conveyed into a pack already kept in an open state, e.g. using a slide or ram. Subsequently the filled pack is closed and removed from the apparatus.

The known apparatuses are generally constructed as fixed installations.

The problem of the invention is to provide an apparatus of this type which, with limited expenditure, makes it possible to adapt the apparatus to different circumstances, e.g. to different pack sizes. The conveying paths are to be kept short, so that a high processing speed can be achieved.

SUMMARY OF THE INVENTION

According to the invention this problem is solved by an apparatus having the features of claim 1. Further developments of the invention form the subject matter of subclaims.

For example, the station in which the pack is closed can be located at a fixed point. If packs with different sizes are to be filled, then the station for opening the pack can be positioned at varying distances with respect to the fixed closing station, the distance being chosen in such a way that the conveying path of the already filled pack to the closing station is as short as possible. It is obviously also possible to keep the opening station fixed and to arrange the closing station with different spacings. It is also possible to move both stations.

The stations can in particular be interchangeably fixed to at least one rail. This makes it possible to interchange stations with other stations of different size or operating speed, or simply introduce an additional station. This is more particularly of interest if the operator initially purchases the apparatus for one product series and subsequently wishes to convert therefrom e.g. to four rows, series or layers.

It can in particular be provided that the apparatus has a device for producing an air cushion between the rail and the displaceable station. This air cushion is produced if the station is to be moved. This reduces friction, so that the stations can be easily moved without requiring expensive ball bearings or the like.

The stations can be fixed with the aid of clamping plates, clips or other elements, which are e.g. known in connection with machine tools.

If the articles to be packed are of the type which require compression prior to introduction into the pack, e.g. diapers, according to the invention the apparatus can have a compressing station, which is also interchangeable and is fixed in such a way to the rail that it can be adjusted along it. If it is necessary to fill larger packs with e.g. two juxtaposed stacks of diapers, the apparatus makes it possible to juxtapose e.g. two identically constructed compressing stations for in each case one stack and to remove same on returning to the smaller pack size.

The slide or ram moving the articles from the feed station into the pack and together with the latter to the discharge station can, according to a further development of the invention, have a reciprocating construction, it being possible according to the invention to modify the location at which the slide movement is reversed. This also makes it possible to achieve a higher processing speed, because with smaller packs the slide no longer needs to be completely moved back and instead is only moved to the feed station. It is obviously also conceivable that one slide movement reversal point is fixed, namely the reversal point at the end of the apparatus.

The implementation of the at least one or preferably both adjustable reversal points can e.g. take place in that the slide is fitted to a carriage given a reciprocating construction and which is e.g. driven by a servomotor. It is then very simply possible to modify the reversal points.

According to the invention, during the return movement the slide can be moved out of the path of the articles. Thus, during the return movement the delivery of the articles to be packed can be continued. According to the invention, the moving out of the slide can take place in that a geared motor is positioned on the carriage moving the slide and is supplied with power by means of a carried trailing cable or the like and at any desired location can bring about the movement of the slide into or out of the path.

For further increasing the operating speed, according to the invention two alternately acting slides can be provided, which are guided in such a way that during the return movement they are moved out of the path of the in each case other slide. Each slide can have its own linear drive, so that the drive of the two slides can take place independently of one another.

For introducing the articles to be packed into the pack it is possible to provide a shaft movable in the conveying direction and which can also be reciprocated between two adjustable reversal points. This shaft serves to receive the optionally compressed articles and is then introduced together therewith into the pack. The shaft movement reversal point adjustment here again serves to keep the conveying paths as short as possible.

In addition, the adjustment of the reversal points of the shaft movement naturally also serves to permit adaptation of the installation to different pack sizes.

As a result of the movable shaft there is a replacement of the bag spreading doors hitherto used in the prior art. Thus, the apparatus is made simpler and fewer parts are required. In the case of a pack format change the changeover time is shorter. There is also a clear improvement to the pack appearance.

The shaft is introduced into the bag to the bottom of the latter. Thus, the friction between the filling material and the bag no longer leads to the sliding of the outer pack layer, e.g. a diaper. This also improves the pack appearance.

The invention proposes that at least partly the bowing of the side walls is adapted to that of the finished pack. This prevents excessive overcompression of the products in the compressing station.

The bowing of the side parts can extend in the conveying direction over the entire bag depth. In the shaft part which is not introduced into the bag, the side walls can be flat or planar, i.e. adapted to the compressing station.

According to the invention, the shaft side walls are at least partly hollow, so that an air cushion can be produced. The air cushion can be formed either on the insides of the side walls, i.e. between the shaft and the articles to be packed, or on the outside of the side walls, i.e. between bag and shaft.

If for some reason a bag is not opened, the articles to be packed can be moved out of the trouble area via the shaft, which in this case passes through the opened welding jaws of the sealing station, without the machine stopping.

The packs are particularly advantageously bags, preferably made from a plastics material. In this case the station for bag opening is preferably equipped with a suction mechanism, which separates the two walls of the initially flat bag and for securing the bag walls, as soon as they have been opened, it is also possible to provide mechanical devices, e.g. hooks.

The suction device e.g. has two vertically movable suckers. The suckers move outside the shaft area, i.e. outside the area of the cross-section of the opened bag. In the prior art the suckers move within the opened bag cross-section. Through the use of pivotable hooks the bag can be released from the sucker in a virtually open state.

As soon as the bag is filled and moved from the slide by a short distance towards the sealing station, the suckers can be moved down again in order to exert suction on the next bag. This leads to an apparatus capacity not possible with the previously known methods.

The hooks pivot or swivel immediately after the raising of the bag through the sucker and pass beneath the latter, assisting it on raising the bag.

A servo geared motor can in particular be provided for the upward and downward movement of the suckers. Thus, it is possible to modify the stroke of the suction mechanism during the operation of the apparatus. This makes it possible to handle a bag stack from top to bottom without the stack having to be raised. The in each case top bag can be at a different height without this slowing down the apparatus. This measure of modifying the lower reversal point of the suction mechanism greatly simplifies the supply means for the bag stack.

When plastic bags are used, the sealing station is in particular a welding station, which welds or seals the bags following the filling thereof.

BRIEF DESCRIPTION OF THE DRAWINGS

Further features, details and advantages can be gathered from the claims, whose wording is made by reference into part of the content of the description, the following description of a preferred embodiment of the invention and the attached drawings, wherein show:

DETAILED DESCRIPTION OF THE PREFERRED EMBODIMENT

Figure 1:
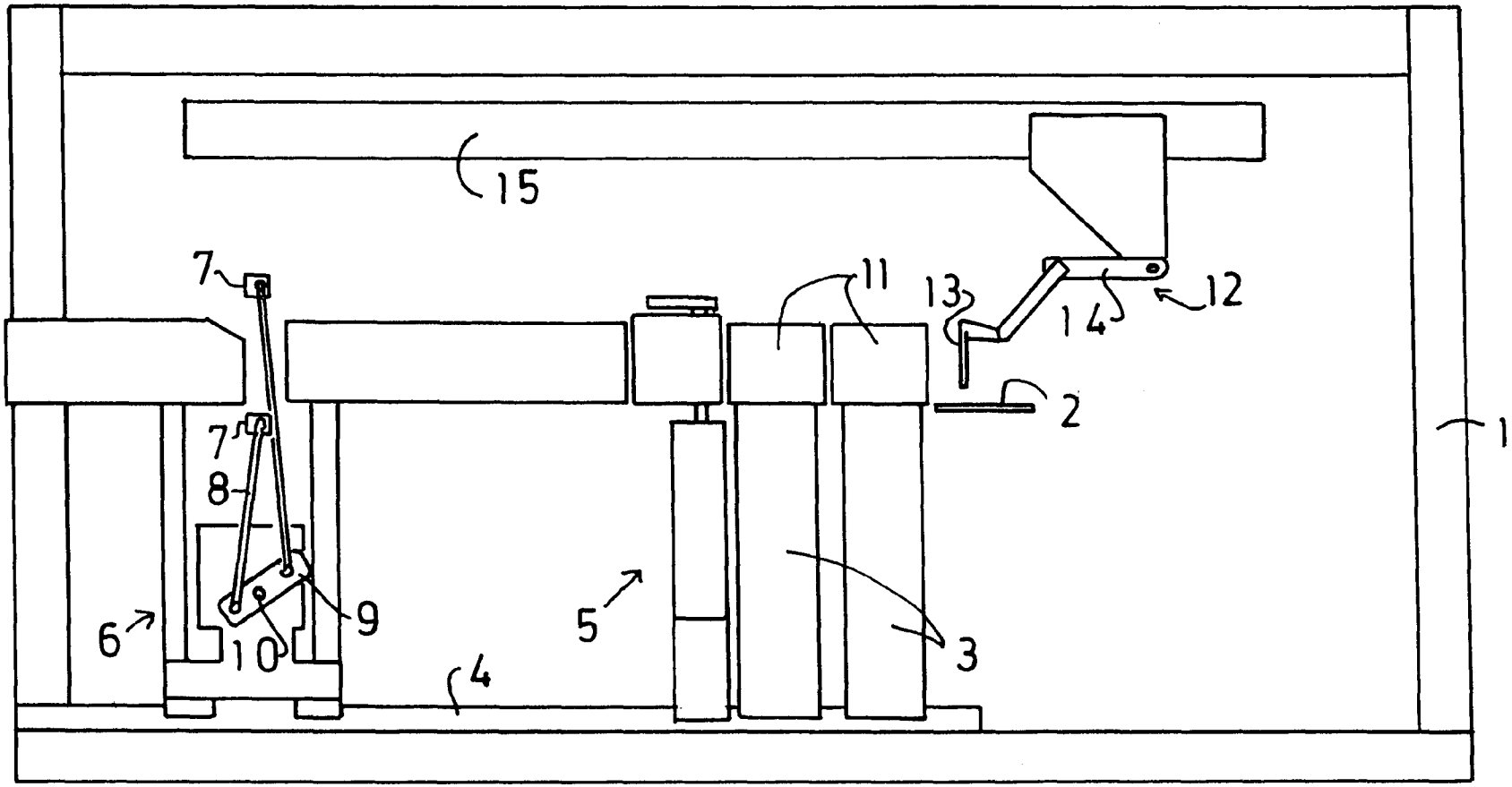
FIG. 1 Diagrammatically a side view of an apparatus according to the invention.

FIG. 1 shows in greatly simplified form an apparatus according to the invention in a machine frame 1. The side view shows the apparatus in such a way that the conveying direction in which the articles are conveyed through the apparatus passes from right to left. The individual parts of the apparatus will initially be described in the same direction. The articles to be packed are introduced into the apparatus at a feed station 2. Introduction can e.g. take place from the rear or from the front, i.e. perpendicular to the paper plane.

To the feed station are connected in the conveying direction two compressing stations 3, which are placed on two rails 4 and fixed thereto. Immediately behind the compressing stations 3, i.e. to the left in FIG. 1, is located a station 5 for opening a pack, which prepares, opens and keeps open the pack.

In the conveying direction behind the station for opening and preparing the pack is located a closing or sealing station 6, which serves to seal the filled packs at their entrance side. In the represented embodiment it is a station, which seals a plastic bag with the aid of two movable welding jaws 7. The two welding jaws are movable with the aid of push rods 8, the guidance mechanism for the welding jaws 7 not being shown in order not to overburden the drawing. Both push rods 8 are articulated to swivelling levers 9, which can be swivelled by the sealing station about a shaft 10. During swivelling the two welding jaws 7 are moved towards one another until they meet roughly at half the height of the pack and at this point weld or seal the bag mouth. The sealing station 6 is also mounted on and fixed to the rails 4.

The articles introduced into the apparatus at the feed station are initially inserted between the jaws 11 of the compressing stations, after which the jaws 11 are moved towards one another to compress the articles. In the compressed state they are introduced into the bag already opened and kept open by the station 5 and following insertion are slid together with the pack between the opened welding jaws 7. In an end position the bags with the articles stop, after which the shaft 10 is rotated in order to weld the bag.

For moving the articles a slide or ram 12 is possible, which has a slide plate 13 intended to act on the articles. The slide plate 13 is articulated with the aid of a swivelling lever 14 to the slide 12. The slide 12 is moved in the conveying direction with the aid of a linear drive 15. The left-hand reversal point for the movement of the slide 12 in FIG. 1 is so chosen that the slide brings the filled bag into a position where it can be closed by the station 6 and from there the slide 12 is moved back again by the linear drive 15. In order that the slide plate 13 does not come into conflict with the articles again placed on the feed station 12, the slide plate 13 can be pivoted upwards with the aid of a pivot drive, which can be located in the slide 12 and e.g. can raise the swivelling lever 14 in a clockwise direction. The return movement of the slide 12, i.e. to the right in FIG. 1, takes place to such an extent that the slide plate 13 is again positioned upstream of the articles, i.e. in FIG. 1 to the right of the feed station. It is also possible to adjust this reversal position in which the slide plate is again lowered into the represented position.

If the apparatus shown in FIG. 1 is to fill a smaller pack, then e.g. the right-hand compressing station 3 can be removed from the rails 4. The feed station 2 can then be moved up closer to the remaining compressing station 3 and the right-hand reversal point of the slide 12 can be correspondingly modified. This ensures that short conveying paths are possible not only for the articles to be packed, but also for the slide. In a similar way, if desired, it is possible to modify the spacing between the stations 5 and 6.

Figure 2:
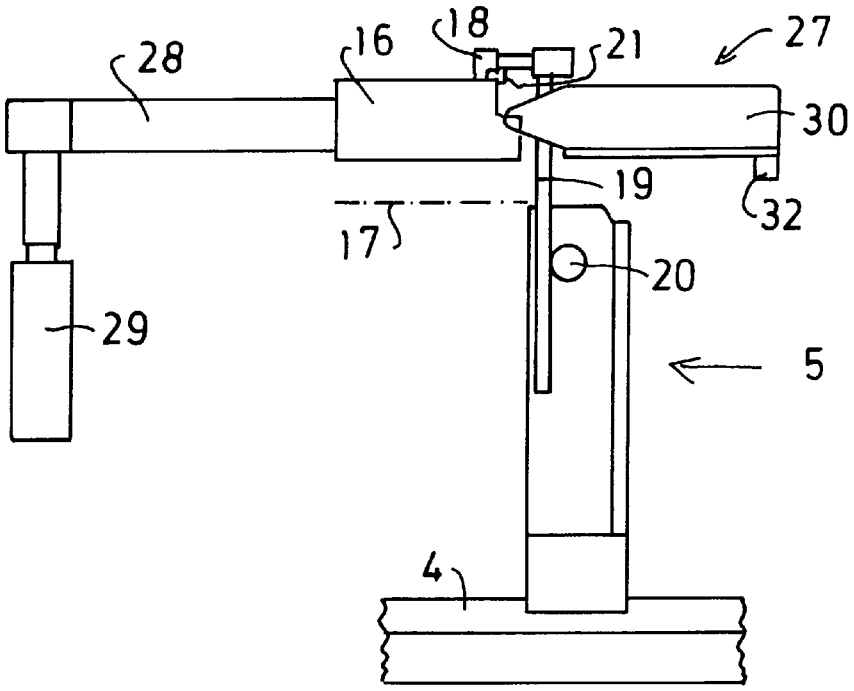
FIG. 2 A side view of a device for moving a shaft.

FIG. 2 shows on a somewhat larger scale the station 5 for preparing, opening and keeping open packs, in the represented embodiment plastic bag 16.

The rail 4 is shown in detail form and on it is fixed the station 5. For opening the bag, delivered in the dot-dash line shown bag plane 17, are provided the two suckers 18 of a suction mechanism arranged on either side of the conveying path. The suckers 18 are arranged in overhanging manner on a guide permitting a vertical upward and downward movement of the suckers 18. For driving the device are provided racks 19, to whose upper end are fitted the suckers 18. With the teeth of the racks 19 meshes a rotated pinion 20, which is only diagrammatically illustrated in FIG. 2. By a clockwise or counterclockwise rotation of the pinion 20 the sucker 18 is moved up and down.

The suckers 18 are so constructed that they initially raise the upper wall of a bag 16. Then a hook 21, pivotably fitted to the sucker 18 and only intimated in FIG. 2 is moved below the upper bag side in order to in this way better hold the bag. Through the upward movement of the sucker 18 the bag 16 is consequently opened and kept in the open state.

Figure 3:
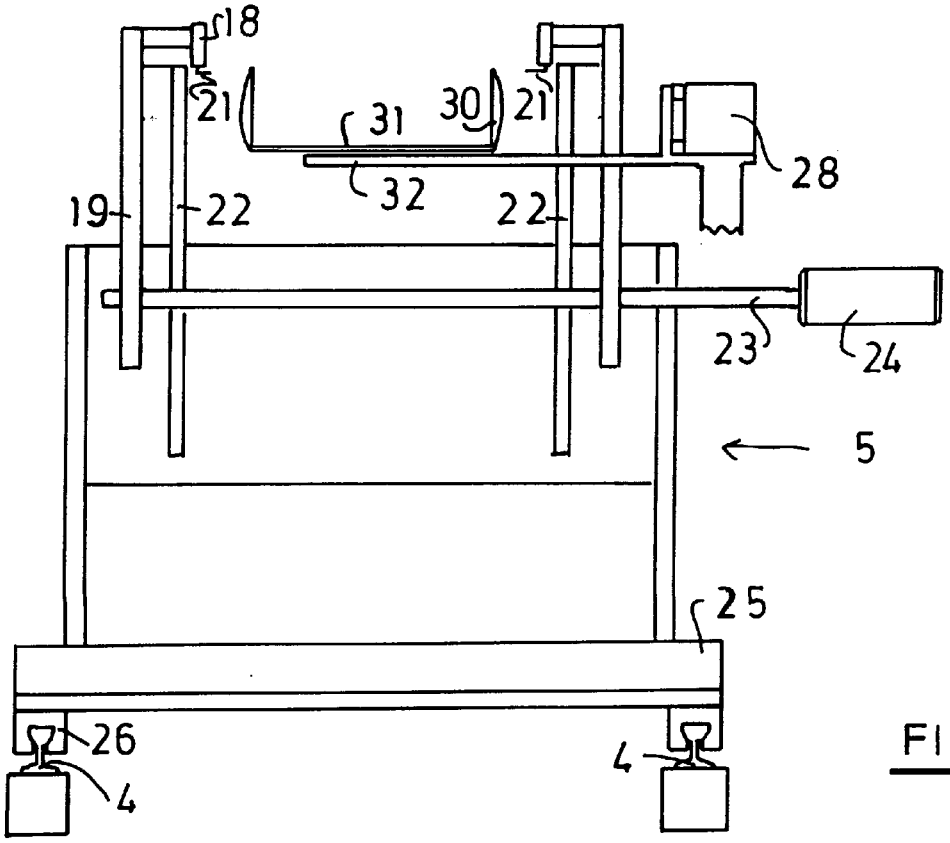
FIG. 3 A front view of the arrangement of FIG. 2.

FIG. 3 also shows the arrangement of suckers 18 on guides 22, shown only in a diagrammatic form. For driving the racks 19 with the aid of the pinions 20 is provided a torque-transmitting shaft 23, which is rotated by a drive 24, e.g. a drive motor.

The station 5 for opening and keeping open the bag 16 is installed on a cross-bar 25, which has on its underside two guide elements 26 for guiding on the rails 4. The guide elements 26 are so constructed that they embrace the rails in the upper area thereof, so as to ensure an exact guidance and orientation of the station 5. The fixing of the station 5 at the desired point in the longitudinal direction of the rails 4 can take place in a random manner, e.g. with the aid of clamping elements.

For introducing the articles to be packed into the opened bag 16 is provided an additionally existing shaft 27, which can be driven in reciprocating manner in the apparatus conveying direction. The shaft 27 is driven by a linear guide 28 with a drive motor 29, cf. FIGS. 2 and 3. The shaft 27 has two side walls 30, which are interconnected by a bottom 31. The leading edge of the side walls 30 of the shaft 27 is provided with a rounded tip, for facilitating introduction into the opened bag 16.

The bottom 31 of the shaft 27 is connected by means of a transversely directed rod 32 to the linear guide 28. The rod is fixed to the front end of the bottom 30 in the conveying direction, so that the shaft 37 can be introduced almost completely into the opened bag.

The articles to be packed are initially introduced by the slide 12 into the shaft 27, optionally in a compressed state and then the shaft 27 moves them into the bag 16. Further conveying again takes place with the aid of the slide, which is possible because the shaft 27 is open at the top. The latter is then again retracted into the starting position. The displacement path of the shaft 27 roughly corresponds to the depth of the bag 16 forming the pack. In the case of bags of different sizes, it is possible to adjust or modify the displacement path of the shaft 27.

Figure 4:
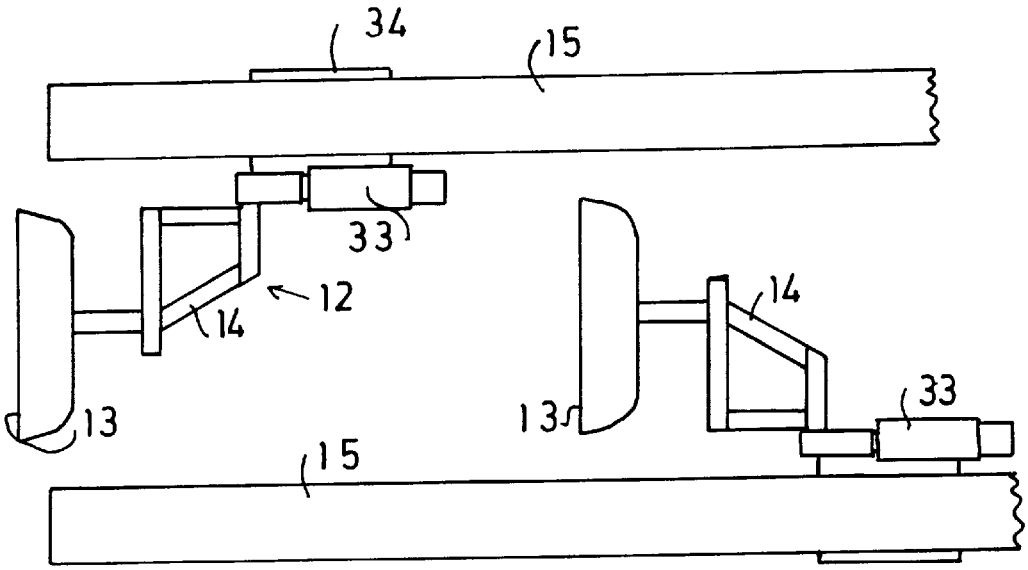
FIG. 4 A plan view of two sides.

FIG. 4 diagrammatically shows a plan view of the installation with two slides 12. Each slide 12 has its own linear drive 15. Both linear drives 15 can operate independently of one another, but are synchronously controlled by a control means in the installation. The two slides 12 operate alternately, so that in each case one slide slides the articles into the pack, whereas the other moves back into the starting position.

The reciprocating movement of the slides 12 can e.g. take place with the aid of revolving toothed belts driven with the aid of motors. The motor rotation direction is reversible, so that the slides can be reciprocated. On each slide is provided its own drive motor 33, which with the aid of a gear can raise and lower the swivelling arm or lever 14. This makes it possible to raise the slide plate 13 of the returning slide with the aid of the swivelling arm 14 and after reaching the starting position shown to the right in FIG. 1 lower the same again. The motors 33 can be supplied with power by means of carried trailing cables. In a similar way it would also be possible to supply a pneumatic motor or the like by means of carried hoses.

Figure 5:
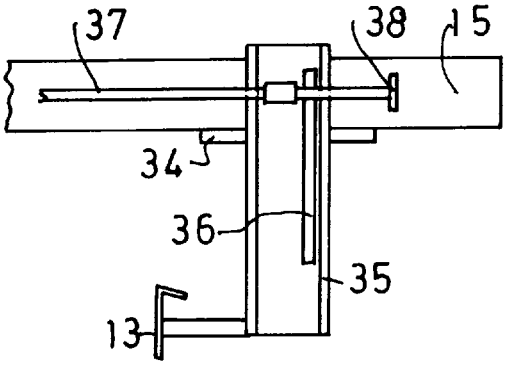
FIG. 5 A detail view of a possibility for moving a slide out of the conveying path.

Whereas in the case of the slides 12 of FIGS. 1 and 4 the raising of the slide plate 13 takes place through a pivoting of the swivelling arm 14, FIG. 5 shows another possibility for moving the slide plate 13 out of the movement path.

In the embodiment of FIG. 5 the slide 33 has a carriage 34 drivable by the linear drive 15, much as in the embodiment of FIGS. 1 to 4. This carriage is consequently only linearly reciprocated. Transversely to the conveying direction an arm 35 is displaceably mounted in the carriage 34 and in the vicinity of its lower end has the slide plate 13. The linearly displaceable arm 35 contains a rack 36, which directly meshes with a torque shaft 37 or with a pinion. The torque shaft 37 extends over the entire linear drive and at each of its ends is mounted in a bearing 38. During the longitudinal displacement of the carriage 35 the engagement between the rack 36 and the torque shaft 37 is maintained, so that by rotating the shaft 37 the arm 35 can be moved up and down at any random point of the linear drive.

Figure 6:
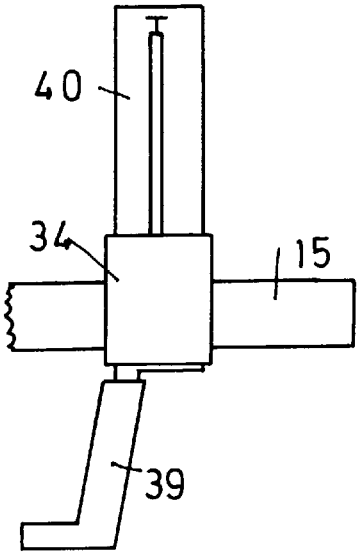
FIG. 6 A representation corresponding to FIG. 5 of a further possibility for moving the slide out of the conveying path.

In the embodiment of FIG. 6 once again on the linear drive 15 is placed so as to be displaceable in the conveying direction a carriage 34 and it contains an arm 40 displaceable transversely to the conveying direction. To the lower end of the arm 40 projecting out of the carriage 34 is fitted an arm 39, which at its front, free end is intended to receive the slide plate 13. The movement of the arm 40 with respect to the carriage 34 takes place with the aid of a piston cylinder, a piston rod-free cylinder, etc. Here the necessary hydraulic fluid can be fed in by a carried hose.

The invention creates an installation, which as a result of the interchanging of components, changing of spacings of the stations fitted to the rails 4 and modifying the reversal points of the movements of the various components can be adapted at limited cost to different pack sizes and different articles to be packed. Despite the possibility of adapting the various circumstances, the installation still has short conveying paths, so that it can operate at a high processing speed.

Figure 7:
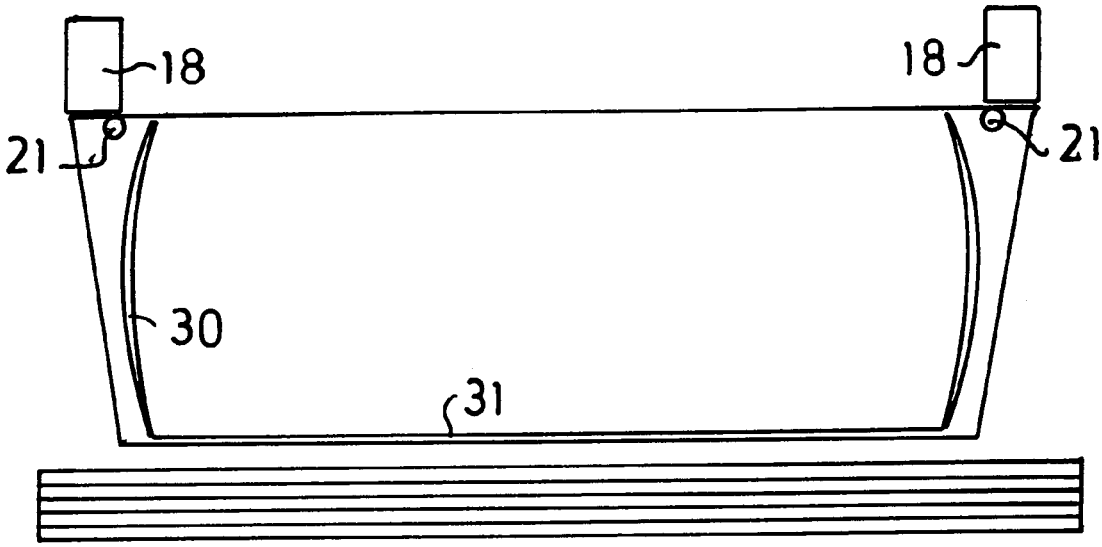
FIG. 7 On a larger scale a view of the movable shaft in the conveying direction.

FIG. 7 shows on a larger scale and in greatly simplified form the mutual arrangement of the stack of bags, the movable shaft 27 and the suction mechanism. It can be seen that the suckers 18 keep the bag open in such a way that they are themselves located outside the cross-sectional area of the shaft 27. The bag is opened to such an extent that it is somewhat larger than the shaft cross-section, so that it can easily be moved into the shaft. The side walls 30 of the shaft 27 are slightly outwardly bowed, so as to give a curvature roughly corresponding to the shape of a filled, sealed bag. This prevents an overcompression of the articles to be packed within the shaft 27.

The side walls 30 are only curved in the shaft area which is located in the bag when the shaft is completely introduced into the latter. That part of the shaft which is then still located outside the bag has planar side walls adapted to the compressing station.

As is diagrammatically shown, the side walls 30 can be hollow or double, so that they can be connected to a compressed air source. By means of optionally valvecontrollable openings on the outside and/or inside of the side walls, it is possible to produce an air cushion, either between the side walls and the articles to be packed or between the side walls and the inside of the bag.

Once the bag has been filled, it is advanced to the left in FIG. 1 by the slide. During this further conveying movement the suckers 18 of the suction mechanism can be lowered again in order to fetch and open the next bag. This can take place simultaneously with the shaft return movement.

If during the operation of the apparatus the height of the bag stack is reduced, there is no need to raise it, because the lower reversal points of the suckers 18 can be modified during the vertical movement thereof.

We claim:

1. Apparatus for packing articles, having a feed station at which the articles to be packed are fed into the apparatus, a station for holding open the pack, a station for sealing the pack after receiving the articles, a slide for conveying the articles in a conveying direction from the feed station into the open pack and then to the station for sealing, as well as with at least one rail running in the conveying direction of the slide, and wherein the station for holding open the pack and the station for sealing are adjustably positioned and secured along said at least one common rail, and are spaced a distance apart that can be adjusted along a length of said at least one common rail.

2. Apparatus according to claim 1 having a device for producing an air cushion between said at least one rail and at least one of the station for holding open the pack and the station for sealing when it is desired to adjust the distance apart along said at least one rail.

3. Apparatus according to claim 1, wherein said station for feeding is also adjustably positioned and secured to said at least one common rail, and spaced a distance apart from the station for holding open the pack, wherein said distance is adjustable along said at least one rail.

4. Apparatus according to claim 1, wherein the apparatus further has at least one compressing station for compressing the articles to be packed into a compressed state prior to the introduction thereof into the open pack, said compressing station being removably and adjustably positioned and secured along the common rail, and spaced a distance apart from the station for holding open the pack, wherein said distance is adjustable along said at least one rail.

5. Apparatus according to claim 1, wherein the slide is arranged in reciprocatable manner between two reversal points having a spacing which is adjustable.

6. Apparatus according to claim 5, wherein the slide has a carriage provided with a geared motor for adjusting the spacing of the reversal points.

7. Apparatus according to claim 1, wherein the slide can be moved out of the path of the articles during return movement of the slide.

8. Apparatus according to claim 1, having a second slide acting alternately with said first-mentioned slide and guided in such a way that on the return movement said second slide and said first-mentioned slide are moved out of the path, in each case, of the other slide.

9. Apparatus according to claim 1, wherein the slide, during its return movement, is moved, by pivoting upwards.

10. Apparatus according to claim 1, further having a shaft movable in the conveying direction said shaft receiving the articles and introducing the articles into the open pack, the shaft having a reciprocating movement between reversal points having a distance that is adjustable.

11. Apparatus according to claim 10, wherein the shaft has at least partly bowed, hollow side walls for receiving air that produces an air cushion.

12. Apparatus according to claim 1, wherein the packs are bags and the station for holding open the bags has a suction mechanism for opening the bags.

13. Apparatus according to claim 12, wherein the suction mechanism has two suckers positioned outside the cross-section of the opened bag and which are vertically movable.

14. Apparatus according to claim 12, wherein the station for sealing has two welding jaws for welding the plastic bags.

* * * * *